US008063329B2

(12) United States Patent
Huang

(10) Patent No.: US 8,063,329 B2
(45) Date of Patent: Nov. 22, 2011

(54) KEY MECHANISM FOR PORTABLE ELECTRONIC DEVICE

(75) Inventor: Po-Hua Huang, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 390 days.

(21) Appl. No.: 12/327,464

(22) Filed: Dec. 3, 2008

(65) Prior Publication Data

US 2009/0301848 A1 Dec. 10, 2009

(30) Foreign Application Priority Data

Jun. 6, 2008 (CN) ..... 2008 1 0302057

(51) Int. Cl.
*H01H 3/42* (2006.01)

(52) U.S. Cl. ..... 200/534; 200/512

(58) Field of Classification Search ..... 200/534, 200/305

See application file for complete search history.

(56) References Cited

U.S. PATENT DOCUMENTS

| | | | | |
|---|---|---|---|---|
| 4,771,139 | A * | 9/1988 | DeSmet | 200/5 A |
| 7,019,225 | B2 * | 3/2006 | Matsumoto et al. | 200/5 R |
| 2006/0042924 | A1 * | 3/2006 | Ito | 200/512 |

FOREIGN PATENT DOCUMENTS

JP 4-115733 U 10/1992

* cited by examiner

*Primary Examiner* — Elvin G Enad
*Assistant Examiner* — Lisa Klaus
(74) *Attorney, Agent, or Firm* — Altis Law Group, Inc.

(57) ABSTRACT

A key mechanism (22) includes a key body (222), a resilient metal sheet (226), a circuit board (26). The circuit board (26) is placed between the key body (222) and the resilient metal sheet (226). The circuit board (26) includes a first surface (2622) facing the key body (222) and a second surface (2624) facing the resilient metal sheet (226). The first surface (2622) has a number of ground points connecting to the key body (222). The second surface (2624) has a switch unit corresponding to the resilient metal sheet (226).

7 Claims, 2 Drawing Sheets

KEY MECHANISM FOR PORTABLE ELECTRONIC DEVICE

BACKGROUND

1. Field of the Invention

The exemplary embodiment relates to key mechanisms and, particularly to key mechanisms for portable electronic devices.

2. Description of Related Art

Key mechanisms of portable electronic devices, such as mobile phones, are usually formed on the sidewalls of housings of portable electronic devices.

FIG. 2 shows a typical key mechanism 10 including a key body 12, a resilient metal sheet 14, a circuit board 16, and a main board 17 connected to the circuit board 16. The resilient metal sheet 14 is positioned between the key body 12 and the circuit board 16. For comfortable touching, a soft film 18 is provided between the resilient metal sheet 14 and the key body 12, and adheres to the elastic sheet 14. The circuit board 16 has a first switch 162 and a spaced second switch 164. During pressing the key body 12, the soft film 18 deforms to electrically connect the resilient metal sheet 14 to the first switch 162 and the second switch 164.

However, the key body 12 is usually made of metallic material, which may generate static electricity. To remove the static electricity, a conducting layer 19 can be placed around the soft film 18, and the conducting layer 19 connects with grounding points 166 of the circuit board 16. Such arrangement increases manufacturing cost of the key mechanism.

Therefore, there is room for improvement within the art.

BRIEF DESCRIPTION OF THE DRAWINGS

Many aspects of the exemplary key mechanism and the portable electronic device using the key mechanism can be better understood with reference to the following drawings. These drawings are not necessarily drawn to scale, the emphasis instead being placed upon clearly illustrating the principles of the exemplary key mechanism. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

Figure 1:
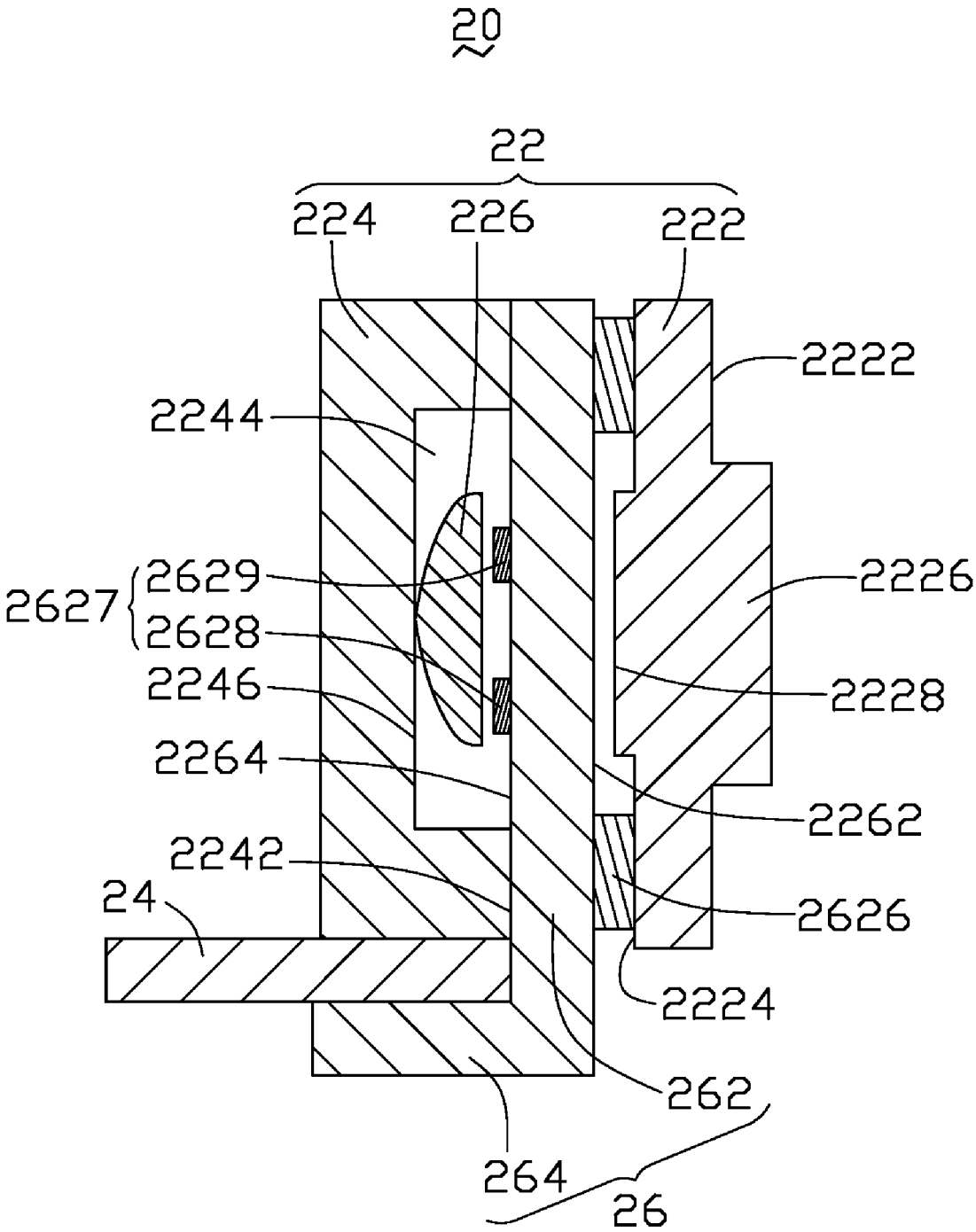
FIG. 1 is a cross-sectional, partial view of a portable electronic device using a key mechanism according to an exemplary embodiment.
Figure 2:
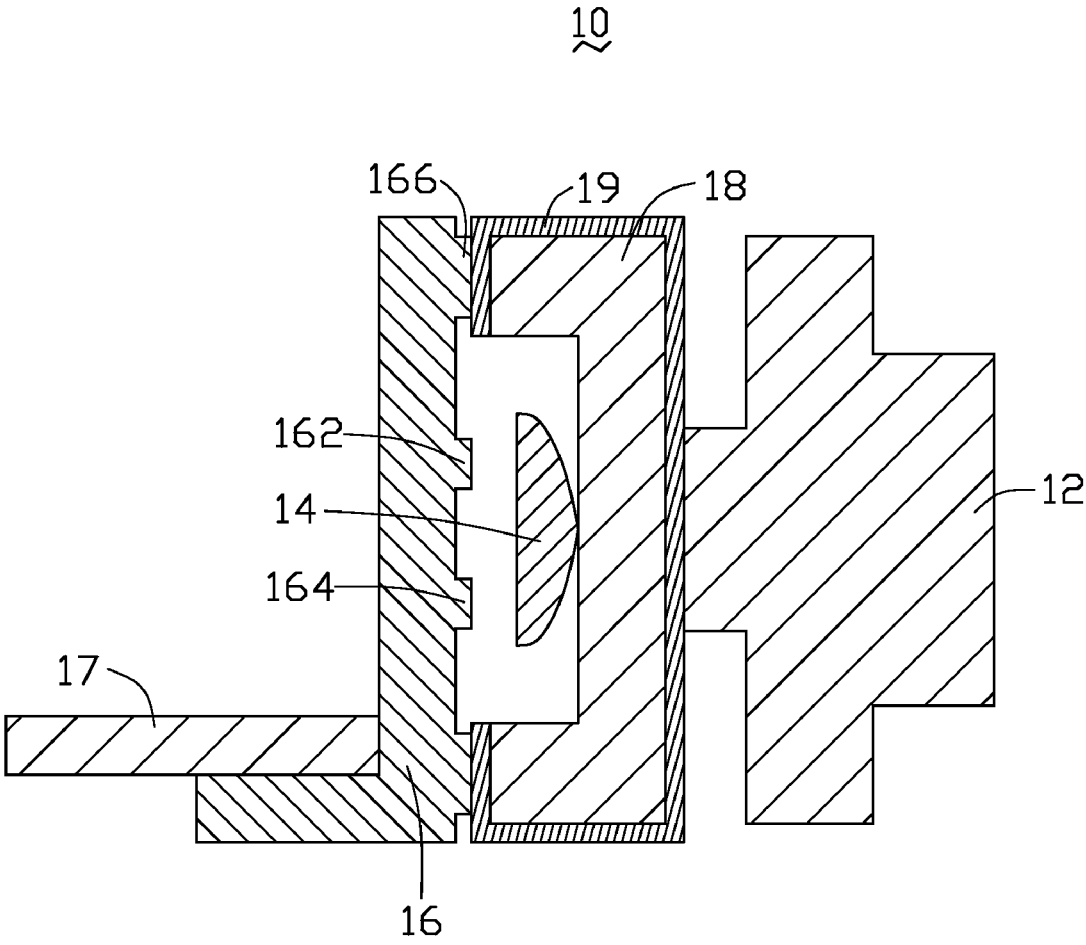
FIG. 2 (RELATED ART)
FIG. 2 is a cross-sectional, partial view of a typical portable electronic device.

FIG. 1 shows a portable electronic device 20 (such as a mobile phone) including a key mechanism 22, a main board 24, and a circuit board 26. The key mechanism 22 electrically connects with the main board 24 by the circuit board 26. The key mechanism 22 includes a key body 222, a soft film 224, and a resilient metal sheet 226 positioned between the key body 222 and the soft film 224.

The key body 222 includes a pressing surface 2222 and a resisting surface 2224 opposite to the pressing surface 2222. The pressing surface 2222 has a pressing portion 2226 protruding outwardly. The resisting surface 2224 faces the resilient metal sheet 226 and has a triggering portion 2228 corresponding to the pressing portion 2226.

The soft film 224 includes a sidewall 2242 facing the key body 222. The soft film 224 has a groove 2244 defined in the sidewall 2242 and a bottom surface 2246 defined in the groove 2244. The groove 2244 is used for accommodating the resilient metal sheet 226 therein, and the resilient metal sheet 226 is attached (e.g., adhered) to the bottom surface 2246.

The circuit board 26 includes a body section 262 and a connecting section 264 perpendicular to the body section 262. The body section 262 is positioned between the key body 222 and the resilient metal sheet 226. The body section 262 includes a first surface 2262 facing the key body 222 and a second surface 2264 facing the resilient metal sheet 226. The first surface 2262 has a plurality of ground points 2626 connecting to the key body 222. The second surface 2264 has a switch unit 2627 corresponding to the resilient metal sheet 226. The switch unit 2627 includes a first switch 2628 and a second switch 2629 spaced from the first switch 2628. The connecting section 264 connects the circuit board 26 with the main board 24.

During pressing the key body 222 toward the circuit board 26, the triggering portion 2228 biases the circuit board 26 toward the resilient metal sheet 226 until the switch unit contacts the resilient metal sheet 226, at this time, the switch unit 2627 conducts with the resilient metal sheet 226 and controls the main board 24. In addition, the static electricity generated during operating the key body 222 may transmit to the ground points 2626, thus preventing electronic components (no shown) on the main board 24 from being damaged by the static electricity.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key mechanism for portable electronic device, comprising:

a key body;

a resilient metal sheet; and a circuit board positioned between the key body and the resilient metal sheet, the circuit board including a first surface facing the key body and a second surface facing the resilient metal sheet, the first surface having a number of ground points connecting to the key body, the ground points for grounding static electricity generated when operating the key body, the second surface having a switch unit corresponding to the resilient metal sheet;

an elastic member including a sidewall facing the key body, the elastic member having a groove defined on the sidewall, thus a bottom wall being defined in the groove, the resilient metal sheet being accommodated in the groove and being attached on the bottom wall.

2. A portable electronic device, comprising:

a main board;

a key body;

a resilient metal sheet; and a circuit board connected with the main board, and the circuit board placed between the key body and the resilient metal sheet, the circuit board including a first surface facing the key body and a second surface facing the resilient metal sheet, the first surface having a number of ground points connecting to the key body, the ground points for grounding static electricity generated when operating the key body, the second surface having a switch unit corresponding to the resilient metal sheet;

a soft film including a sidewall facing the key body, the soft film has a groove defined on the sidewall, thus a bottom wall is defined in the groove, the resilient metal sheet is accommodated in the groove and is attached on the bottom wall.

3. A key mechanism for portable electronic device, comprising:

a key body;

a soft film;

a resilient metal sheet positioned between the key body and the soft film; and a circuit board positioned between the key body and the resilient metal sheet, the circuit board including a first surface facing the key body and a second surface facing the resilient metal sheet, the first surface having a number of ground points connecting to the key body, the ground points for grounding static electricity generated when operating the key body, the second surface having a switch unit corresponding to the resilient metal sheet.

4. The key mechanism as claimed in claim 3, wherein the switch unit includes a first switch and a second switch spaced from the first switch.

5. The key mechanism as claimed in claim 3, wherein the circuit board includes a body section and a connecting section extending from an end of the body section, the body section is positioned between the key body and the resilient metal sheet.

6. The key mechanism as claimed in claim 5, wherein both the ground points and the switch unit are disposed on the body section.

7. The key mechanism as claimed in claim 3, wherein the soft film includes a sidewall facing the key body, the soft film has a groove defined on the sidewall, thus a bottom wall is defined in the groove, the resilient metal sheet is accommodated in the groove and is attached on the bottom wall.

* * * * *